US005489917A

United States Patent [19]

Ikezaki et al.

[11] Patent Number: 5,489,917

[45] Date of Patent: Feb. 6, 1996

[54] LCD APPARATUS WITH IMPROVED GRAY SCALE AT LARGE VIEWING ANGLES AND METHOD AND APPARATUS FOR DRIVING SAME

[75] Inventors: Mitsuru Ikezaki, Kanagawa; Shunji Suzuki, Yokohama; Hideo Takano, Atsugi, all of Japan

[73] Assignee: International Business Machines Corporation, Armonk, N.Y.

[21] Appl. No.: 249,656

[22] Filed: May 26, 1994

Related U.S. Application Data

[63] Continuation of Ser. No. 883,095, May 15, 1992, abandoned.

[30] Foreign Application Priority Data

May 15, 1991 [JP] Japan ..... 3-138668

[51] Int. Cl.[6] ..... G09G 3/36

[52] U.S. Cl. ..... 345/89; 345/87; 345/94

[58] Field of Search ..... 345/89, 87, 94, 345/95

[56] References Cited

U.S. PATENT DOCUMENTS

| | | | |
|---|---|---|---|
| 4,632,514 | 12/1986 | Ogawa et al. | 359/68 |
| 4,672,357 | 6/1987 | Lorteije et al. | 340/793 |
| 4,769,639 | 9/1988 | Kawamura et al. | 340/793 |
| 4,788,588 | 11/1988 | Tomita | 340/793 |
| 4,801,933 | 1/1989 | Yamamoto et al. | 359/55 |

*Primary Examiner*—Ulysses Weldon
*Assistant Examiner*—Matthew Luu
*Attorney, Agent, or Firm*—David Aker; Ronald L. Drumheller

[57] ABSTRACT

A liquid crystal display apparatus in normally-white mode in which gray scale display is obtained by providing different applied voltages corresponding to different gray scale levels, respectively, characterized in that in a curve showing the relationship between the applied voltage and light transmittance, the lowest applied voltage is set so as to be shifted in the direction of a monotonically decreasing region of the curve. The display simultaneously provides both good contrast ratios and good gradation at large viewing angles, and gray scale is not inverted.

11 Claims, 9 Drawing Sheets

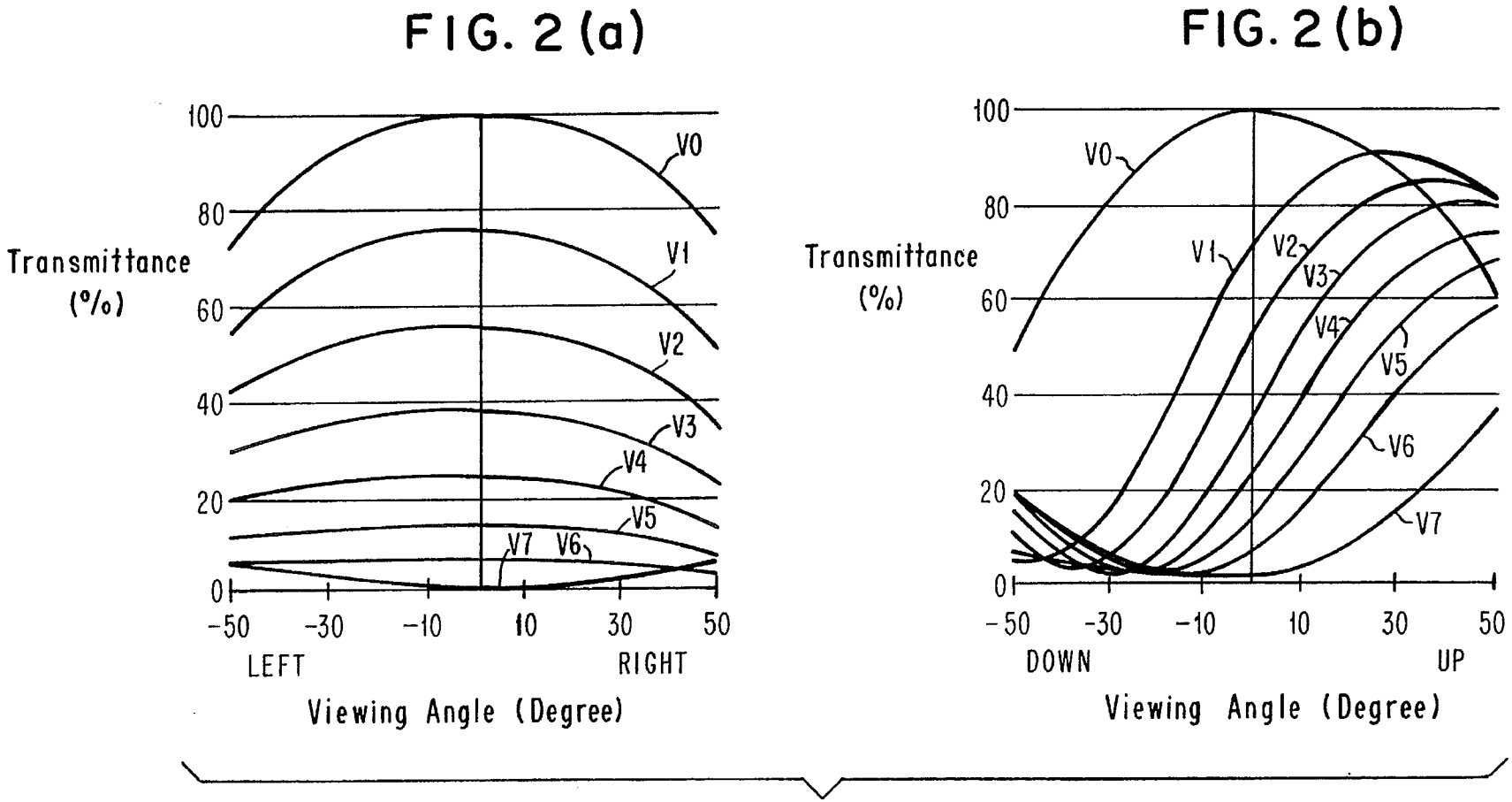
Light transmittance in e mode
Prior Art

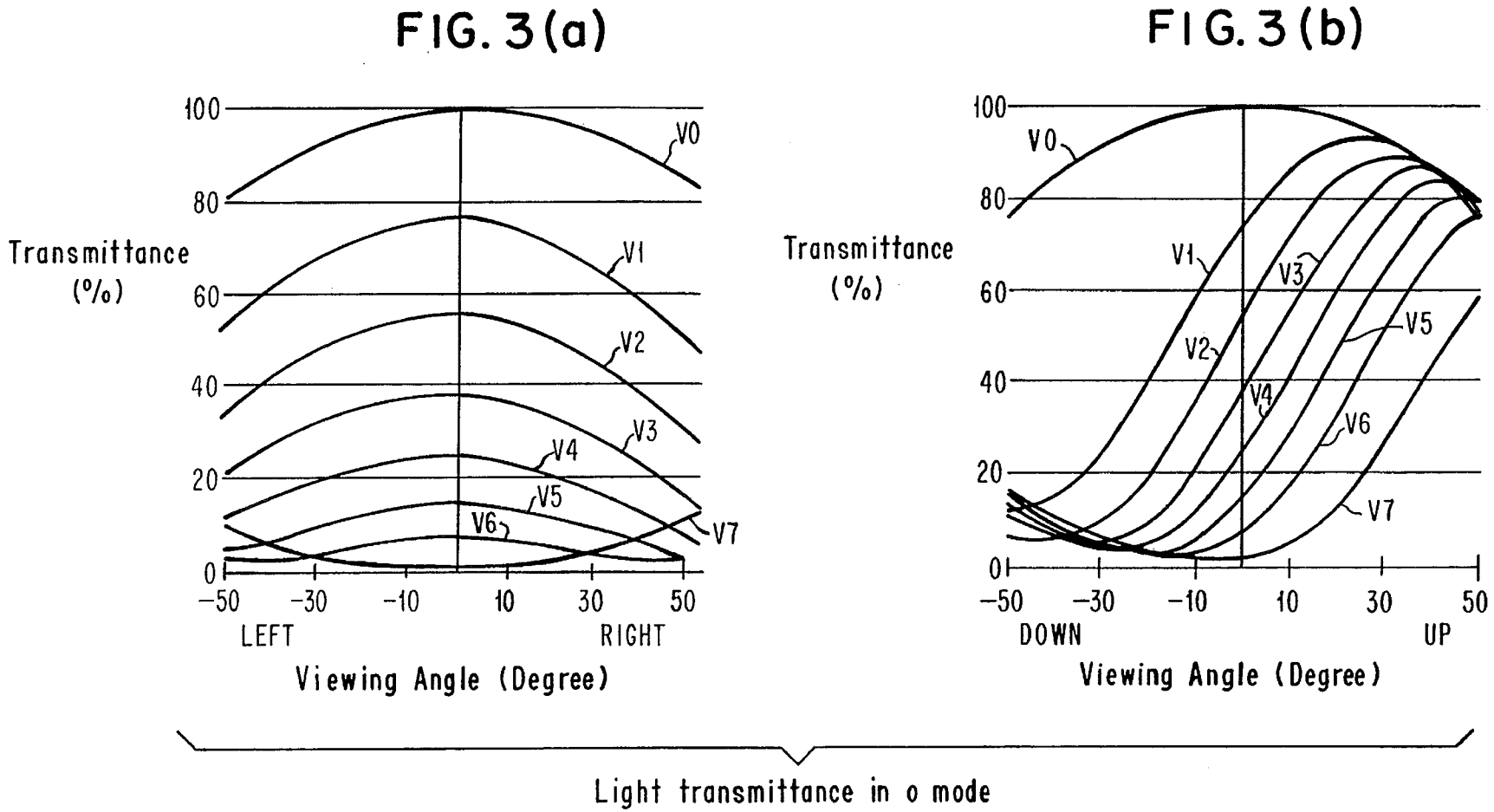
Light transmittance in o mode
Prior Art

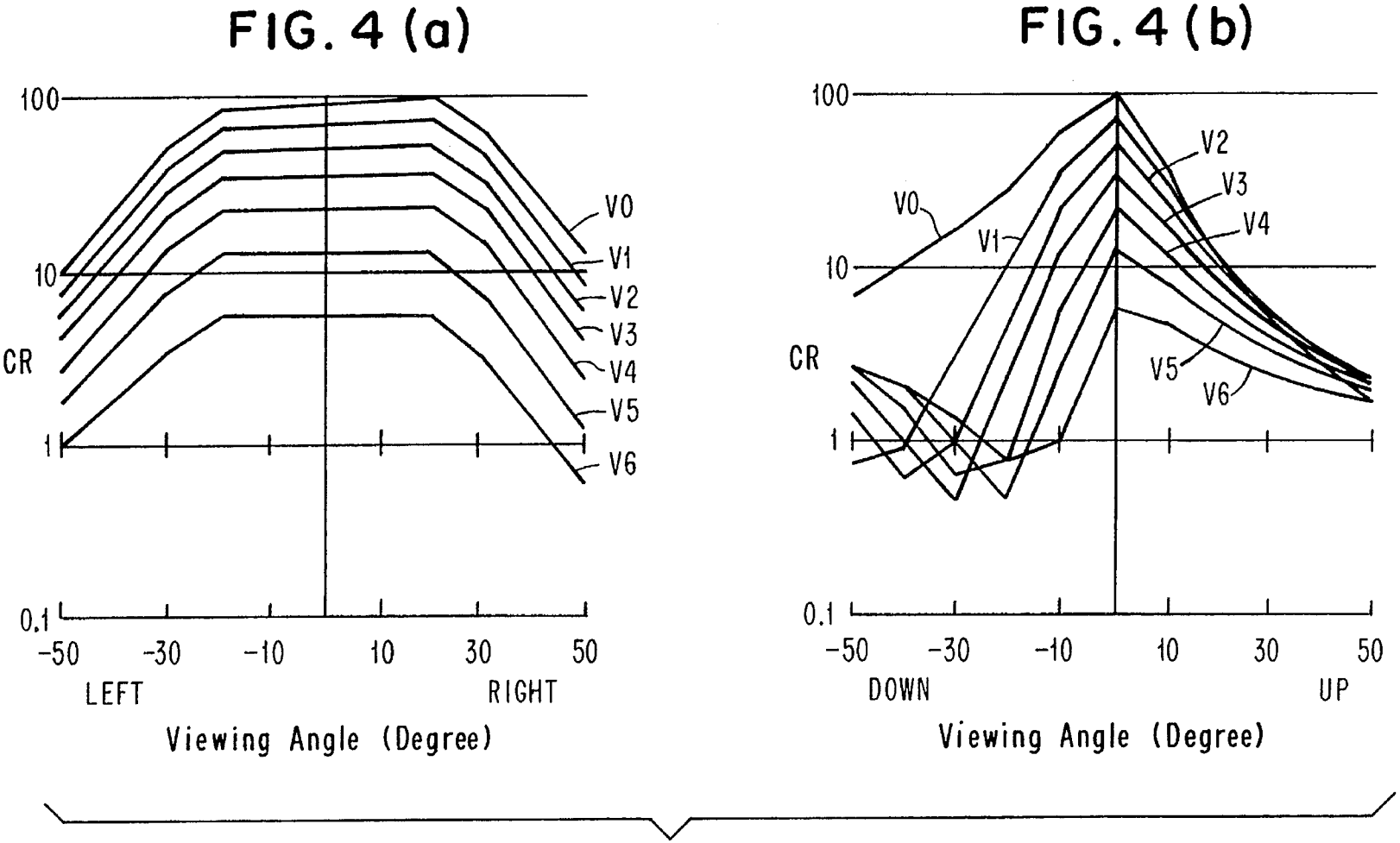
Contrast ratio CR in e mode
Prior Art

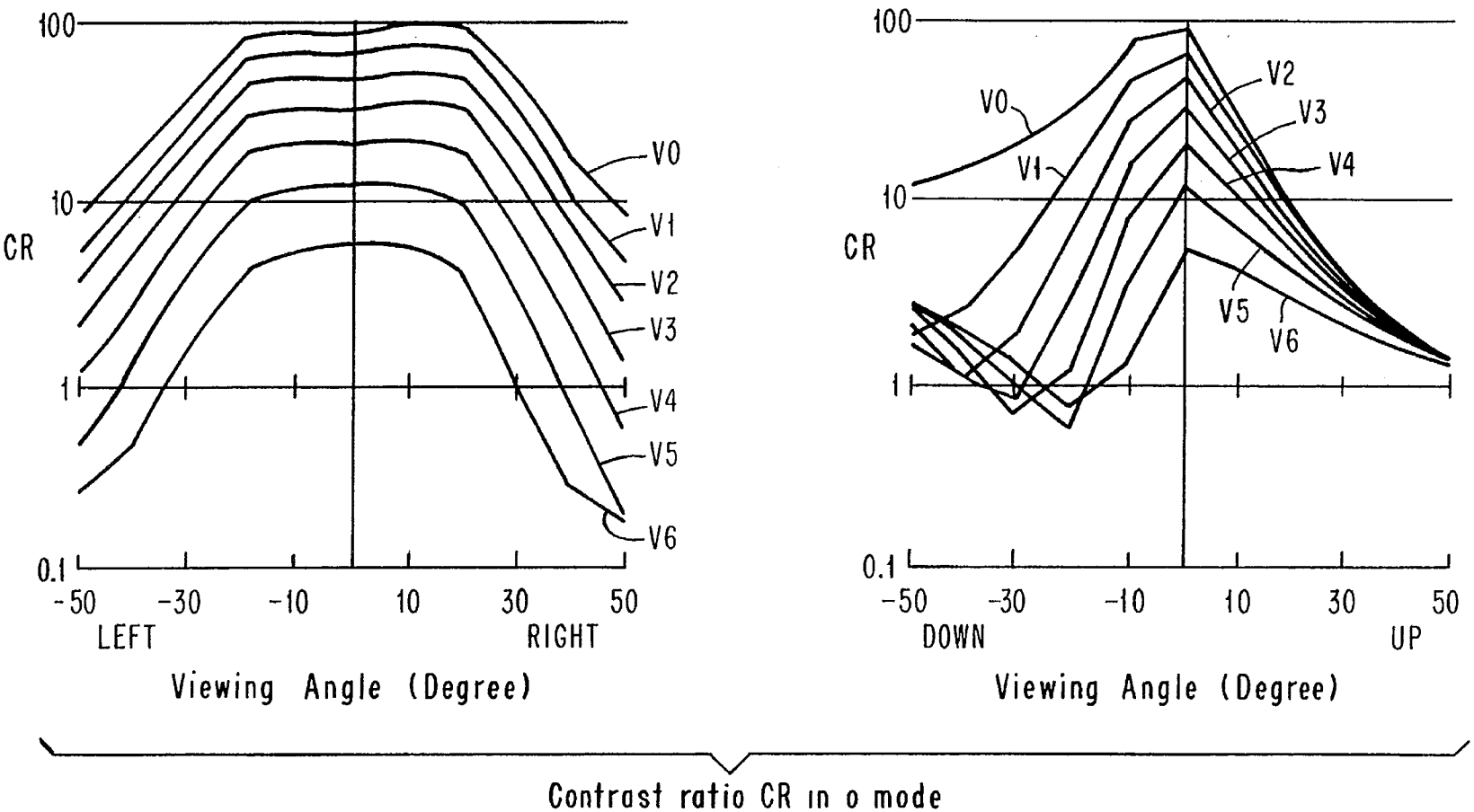
Contrast ratio CR in o mode
Prior Art

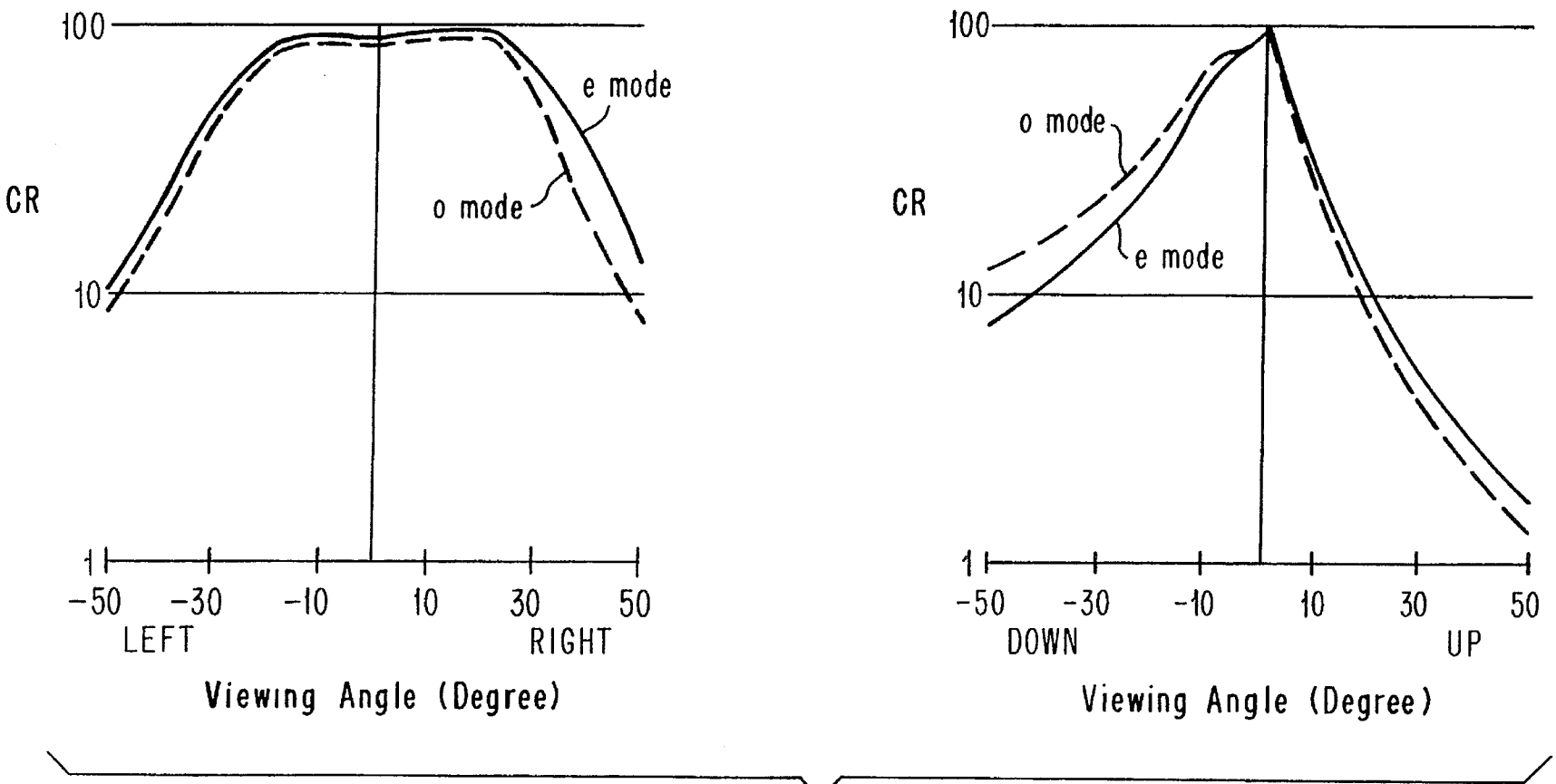
PRIOR ART

LCD APPARATUS WITH IMPROVED GRAY SCALE AT LARGE VIEWING ANGLES AND METHOD AND APPARATUS FOR DRIVING SAME

This is a continuation of application Ser. No. 07/883,095 filed May 15, 1992 now abandoned.

FIELD OF THE INVENTION

The present invention relates to liquid crystal display apparatus using active elements. More particularly, it relates to liquid crystal display apparatus which provide good gray-scale display at large viewing angles, and a method and an apparatus for driving such displays.

BACKGROUND ART

In active matrix-type liquid crystal displays, a twisted nematic (TN) liquid crystal material is used, for among other reasons, so that adequate response characteristics and contrast can be obtained under drive by a low voltage. There are two display modes of the TN-type liquid crystal display. One of the two display modes is a normally-white mode in which a bright display is obtained in a state with no application of voltage and the other is a normally-black mode in which a dark display is obtained in a state with no application of voltage. In the normally-black mode, coloring occurs in a dark state with no application of voltage (due to a condition of shielding light differently depending on the wavelength of the light). This is called optical rotatory dispersion. When it occurs, the contrast ratio will decrease. However, in the normally-white mode, if a sufficient voltage is applied, a good dark state can be obtained, and therefore a high contrast ratio can be implemented. It is for this reason, that a normally-white mode liquid crystal display is generally used.

Each of the above modes can be subdivided into two optical modes, depending on whether or not the transmission axis of a polarizing plate on the incidence side is set in parallel to the rubbing direction on the incidence side. As shown in FIG. 1(*a*), if a transmission axis 12 of a polarized plate on the incidence side is set in a direction parallel to a rubbing direction 14 on the incidence side, an extraordinary ray is transmitted through the liquid crystal material. Therefore, the mode in which such an extraordinary ray is transmitted is called extraordinary-ray dominant mode. As shown in FIG. 1(*b*), if the transmission axis 12 of the polarizing plate on the incidence side is set to make a right angle with the rubbing direction 14 on the incidence side, an ordinary ray is transmitted through the liquid crystal. Therefore, the mode in which such an ordinary ray is transmitted is called ordinary-ray dominant mode. A reference number 16 shown in FIG. 1(*a*) and FIG. 1(*b*) indicates the rubbing direction on the output side.

The viewing-angle dependence of the light transmittance and contrast ratio of the normally-white mode liquid crystal display with, for example, eight-level gray scale is compared for extraordinary-ray dominant mode (hereinafter called e mode) and ordinary-ray dominant mode (hereinafter called o mode). The gray scales are G7 and G0, in order, from the brightest level to the darkest level. Corresponding voltages V0 to V7 (for example, 0 to 5 volts) are applied, respectively.

FIG. 2(*a*) and FIG. 2(*b*) show viewing-angle dependence for relative light transmittance (hereinafter simply called transmittance) in the e mode. The graph of FIG. 2(*a*) shows viewing-angle dependence in the horizontal direction (±50 degrees). The graph of FIG. 2(*b*) shows viewing-angle dependence in the vertical direction (±50 degrees). In the specification, for the horizontal direction, the rightward and the leftward directions are the positive and the negative directions, respectively. For the vertical direction, the upward and the downward directions are the positive and negative directions, respectively. However, such definitions are arbitrary. In FIG. 2(*a*) and FIG. 2(*b*), for example, curves labeled as V0 show viewing-angle dependence of transmittance for voltage V0 in the horizontal and the vertical directions, respectively. In FIG. 3(*a*) and FIG. 3(*b*), similarly, viewing-angle dependence of transmittance in the o mode is shown.

As is apparent from FIG. 2(*b*), with respect to the viewing-angle characteristic of transmittance (T) in an up-viewing zone, in the e mode the curve indicated by V0 is below a curve indicated by V1 at angles greater than +25 degrees. Essentially, the application of voltage V0 should cause transmittance to be maximum. However, the application of voltage V0 does not cause the highest transmittance at angles in excess of +25 degrees in the up-viewing zone, but the application of voltage V1 or V2 causes higher transmittance than V0. Such a phenomenon, that is that a correspondence of the order of applied voltage levels with that of gray scale levels is lost, is hereinafter called, for convenience of explanation, "brightness inversion" or "gray-scale inversion". As is apparent from FIG. 3(*b*), in the o mode, the viewing-angle characteristic of transmittance in up- and down-viewing zones has a similar tendency. However, in comparing the o mode with the e mode, it is found that the former is excellent in its characteristics. In comparing the viewing-angle characteristic of transmittance in right- and left-viewing zones in the o mode with that in the e mode, both the o and the e modes are excellent in their characteristics, but the latter is a little better than the former. A range of viewing angles within which gray-scale inversion does not occur is indicated by circles along lines representative of transmittance of 100%. Transmittance is also referred to herein as gradation.

FIG. 4(*a*) and FIG. 4(*b*) show viewing-angle dependence of contrast ratios CR in e mode. A contrast ratio is defined as contrast with the darkest gray-scale level G0 corresponding to the highest applied voltage V7. The graph of FIG. 4(*a*) shows viewing-angle dependence in the horizontal direction (±50 degrees). The graph of FIG. 4(*b*) shows viewing-angle dependence in the vertical direction (±50 degrees). For example, in FIG. 4(*a*) a curve indicated by V0 shows viewing-angle dependence in the horizontal direction with respect to a ratio of transmittance (gray scale G0) corresponding to voltage V0 to transmittance (gray scale G7) corresponding to voltage V7. Similarly, a curve indicated by V6 shows viewing-angle dependence in the horizontal direction with respect to a ratio of transmittance (gray scale G6) corresponding to voltage V6 to transmittance (gray scale G7) corresponding to voltage V7. Further, in FIG. 4(*b*) a curve indicated by V0 shows a viewing-angle dependence in the vertical direction with respect to a ratio of transmittance (gray scale G0) corresponding to voltage V0 to transmittance (gray scale) G7) corresponding to voltage V7. Similarly, a curve indicated by V6 shows viewing-angle dependence in the vertical direction with respect to a ratio of transmittance (gray scale G6) corresponding to voltage V6 to transmittance (gray scale G7) corresponding to voltage V7.

FIG. 5(*a*) and FIG. 5(*b*) show viewing-angle dependence for contrast ratios CR in a o mode, in a similar manner.

As shown in FIG. 2(*a*) and FIG. 2(*b*), FIG. 3(*a*) and FIG. 3(*b*), FIG. 4(*a*) and FIG. 4(*b*) and FIG. 5(*a*) and FIG. 5(*b*), a range of viewing angles within which gray-scale inversion does not occur, is indicated by circles along the lines for the contrast ratio of 100. With respect to a contrast ratio, one at the brightest level is actually predominant over others. Therefore, in FIG. 6(*a*) and FIG. 6(*b*) a comparison of the ratios of transmittance (gray scale G0) corresponding to voltage V0, to transmittance (gray scale G7) corresponding to voltage V7 in o mode and in e mode, is made. As is evident from FIG. 6(*a*) and FIG. 6(*b*), the viewing-angle characteristic of contrast ratio in e mode is superior in the right- and left-viewing zones. With respect to up- and down-viewing zones, o mode is superior in the down-viewing zone and e mode is superior in the up-viewing zone.

Prior art relating to the present invention is Japanese Published Unexamined Patent Applications (PUPA) No. 61-121087, No. 62-196625, and No. 1-201622.

In the prior art, as described above, the viewing-angle characteristics for contrast ratio and gradation of a normally-white mode liquid crystal display have both advantages and disadvantages in both o or e mode. In both modes good contrast ratio and good gradation cannot be simultaneously obtained at a large viewing angle.

SUMMARY OF THE INVENTION

It is an object of the present invention to provide a liquid crystal display apparatus which simultaneously satisfies the requirements of good contrast ratio and good gradation at a large viewing angle.

It is another object of the invention to provide a method for driving such a display.

It is yet another object of the invention to provide an apparatus for driving the display.

In accordance with the present invention, to accomplish the above object, in a normally-white mode liquid crystal display apparatus, in which gray scale display is obtained by providing different applied voltages corresponding to different respective gray scale levels, in a curve showing the relationship between applied voltage and transmittance (hereinafter called a V-T curve), the lowest applied voltage is set so as to be shifted in the direction of a monotonically decreasing region of the V-T curve. Thus, brightness inversion or gradation inversion is avoided. Both good contrast ratio and good gradation can be obtained at a large viewing angle.

BRIEF DESCRIPTION OF THE DRAWINGS

FIG. 2(*a*) and FIG. 2(*b*) are diagrams showing viewing-angle dependence for relative light transmittance in e mode.

FIG. 3(*a*) and FIG. 3(*b*) are diagrams showing viewing-angle dependence for relative light transmittance in o mode.

FIG. 4(*a*) and FIG. 4(*b*) are diagrams showing viewing-angle dependence for contrast ratios in e mode.

FIG. 5(*a*) and FIG. 5(*b*) are diagrams showing viewing-angle dependence for contrast ratios in o mode.

FIG. 6(*a*) and FIG. 6(*b*) are diagrams showing a ratio of light transmittance (gray scale G0) corresponding to voltage V0 to light transmittance (gray scale G7) corresponding to voltage V7 for comparing o mode with e mode.

DETAILED DESCRIPTION OF THE PREFERRED EMBODIMENTS

To assist in understanding the present invention, it is described by comparison to the prior art. As described above with reference to FIG. 6(*a*) and FIG. 6(*b*), the viewing-angle characteristic of contrast ratio in e mode is superior in both right- and left-viewing zones. With respect to the up and down zones, o mode is superior in the down-viewing zone and e mode is superior in the up-viewing zone. It is clear that the viewing-angle characteristic of contrast ratio in e mode is superior in the right- and left-viewing zones, and is at a good level. However, with respect to up- and down-viewing zones, neither mode has a good viewing-angle characteristic in the up-viewing zone, and o mode is clearly superior in the down-viewing zone. If a downward direction is assumed to be a usual direction, o mode can be used to obtain a relatively good contrast ratio. However, as is evident from FIG. 3(*a*) and FIG. 3(*b*) in a down-viewing zone, particularly in a zone of low transmittance, gray-scale inversion occurs, and thereby gradation significantly decreases. Conventionally, gradation is sacrificed for contrast ratio to adopt the downward direction as a usual direction. According to all considerations of viewing-angle characteristics in terms of contrast ratio and gradation, contrast ratios are at nearly equivalent level in e and o modes in right- and left-viewing zones and up- and down-viewing zones, and e mode is inferior to o mode only for gradation in the up-viewing zone. However, if the up-viewing zone can be used as the usual direction to prevent gray-scale inversion in an up-viewing zone in e mode, e mode will have the more balanced viewing-angle characteristic of contrast ratio and gradation than o mode.

Figure 1A:
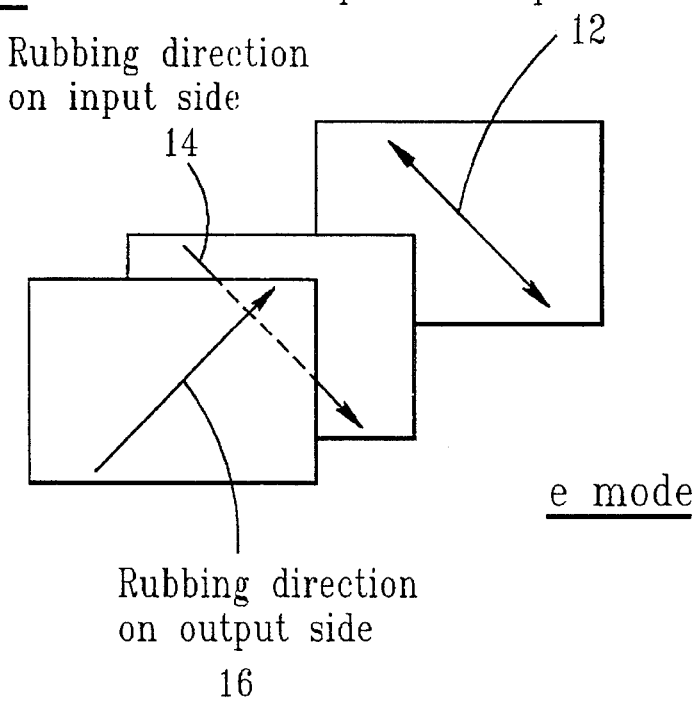
FIG. 1(a) PRIOR ART
FIG. 1(*a*) and FIG. 1(*b*) are diagrams for explanation of two optical modes.
Figure 1B:
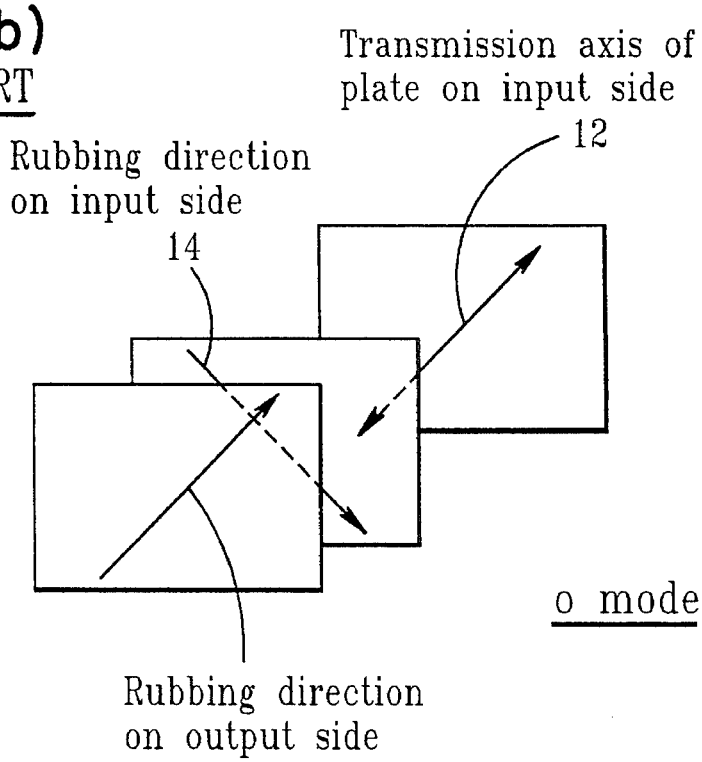
FIG. 1(b) PRIOR ART
Figure 7:
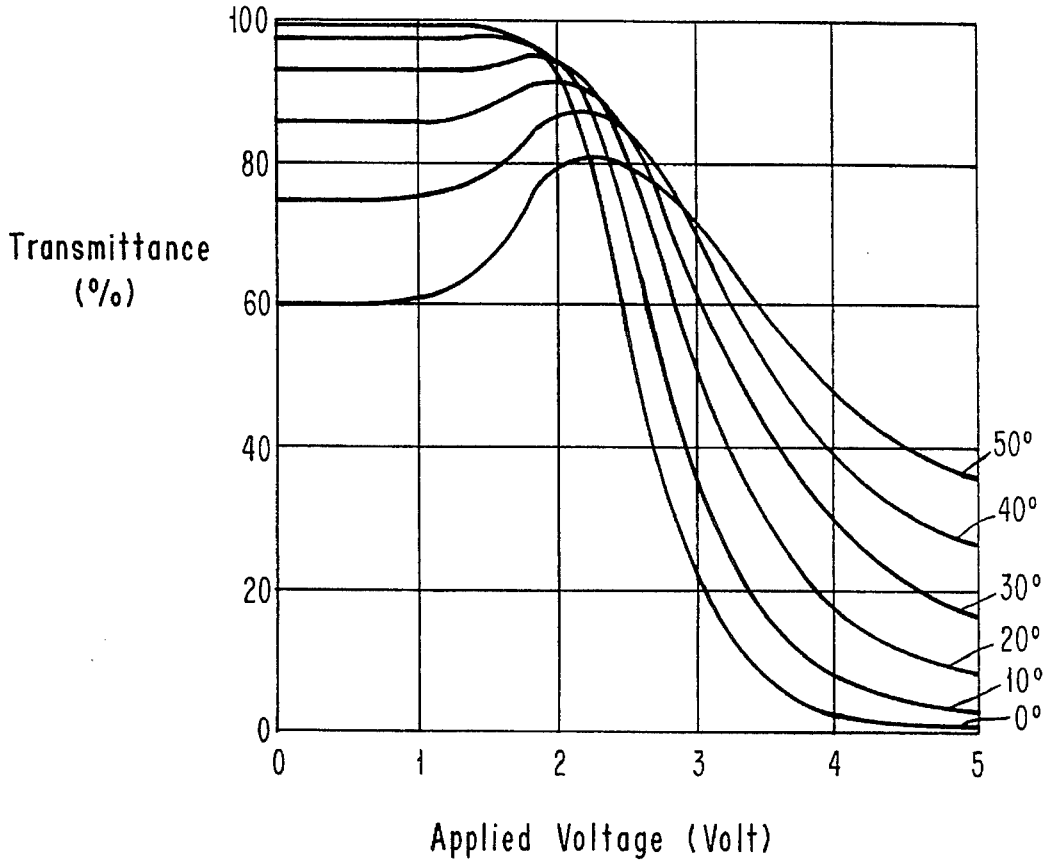
FIG. 7 is a diagram showing the relationship between relative light transmittance and applied voltage plotted for each angle in an up-viewing zone.

The essence of the present invention is a method for preventing gray-scale inversion in the up-viewing zone in e mode. FIG. 7 is a graph showing the relationship between applied voltage plotted for each angle in the up-viewing zone, used as a parameter, and transmittance (the V-T curve). The angles vary in steps of 10 degrees within the range from 0 degrees to 50 degrees in the up-viewing zone. For eight-level gray-scale display, in the above example of the prior art, applied voltages of, for example, V0=0 volts, V1=2.4 volts, V2=2.6 volts, V3=2.8 volts, V4=3.1 volts, V5=3.4 volts, V6=3.8 volts, and V7=5 volts are applied in ascending order. The applied voltages are set after consideration of predetermined gamma correction based on transmittance at a viewing angle of 0 degrees. In FIG. 7, a curve for the viewing angle of 0 degrees is level until an applied voltage reaches approximately 1.8 volt and then monotonically decreases. Therefore, gray-scale inversion will not occur at a viewing angle of 0 degrees. The peaks of transmittance occur at the applied voltage of about 2 volts at viewing angles in excess of 20 degrees to 30 degrees. This means that gray scale starts to invert at viewing angles larger than 20 degrees to 30 degrees.

According to the present invention, gray-scale inversion is prevented by shifting the lowest applied voltage V0 in the direction in which the above V-T curve monotonically decreases. There are various embodiments of the invention based on how the lowest applied voltage V0 is set. One embodiment is a case where the lowest applied voltage is set to a voltage greater than or equal to a voltage corresponding to the maximum in a V-T curve. The other embodiment is a case where the lowest applied voltage is set to a voltage less than the voltage corresponding to the maximum in a V-T curve. Further, for each embodiment there are some cases where, for example, a V-T curve is selected as the appropriate V-T curve at a predetermined viewing angle with respect to the direction of a line normal to a display surface of the liquid crystal display apparatus. An integrated V-T curve obtained as a result of integration of the V-T curve between a viewing angle of 0 degrees and a predetermined viewing angle with respect to the direction of the line normal to the display surface of the liquid crystal display apparatus, may also be selected. These embodiments are described in order.

Figure 8B:
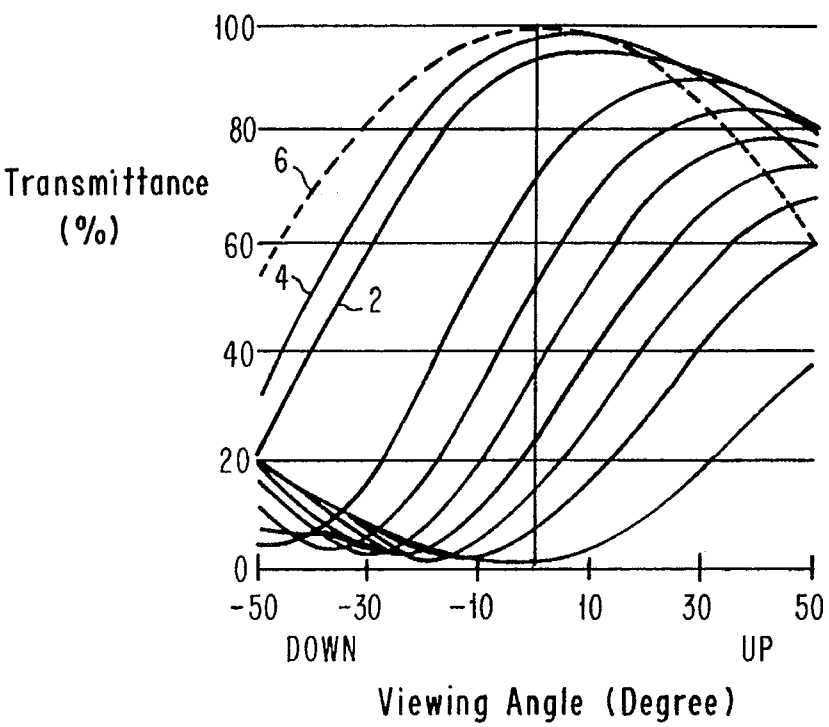
FIG. 8(*a*) and FIG. 8(*b*) are diagrams showing viewing-angle dependence for light transmittance in the horizontal and the vertical directions according to the present invention.
Figure 8A:
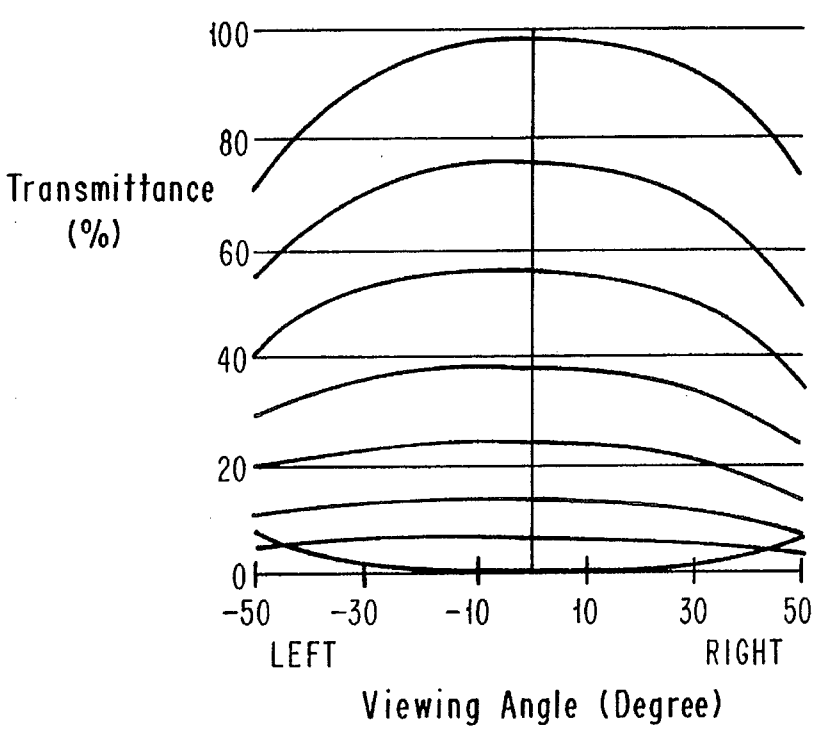

In FIG. 7, the peaks (that is, maximums) of transmittance occur at an applied voltage of about 2 volts for viewing angles in excess of 20 to 30 degrees. Therefore, the lowest applied voltage V0 can be set to a voltage (about 2 volts) greater than a voltage corresponding t a maximum of transmittance. In this case, applied voltages are set to V0=2.0 volts, V1=2.4 volts, V2=2.6 volts, V3=2.8 volts, V4=3.1 volts, V5= 3.4 volts, V6=3.8 volts, and V7=5 volts. FIG. 8(*a*) and FIG. 8(*b*) show viewing-angle dependence of transmittance in the horizontal and the vertical directions in the case where the lowest applied voltage V0 is set to about 2.0 volts. In FIG. 8(*b*), a curve indicated by a dashed line 6 shows transmittance corresponding to the lowest applied voltage in the case of no application of the present invention and a curve indicated by a solid line 2 shows transmittance corresponding to the lowest applied voltage in the case where the present invention is used and the lowest applied voltage V0 is set to about 2.0 volts. Comparing the curve 6 with the curve 2, it is clear that there is an improvement in the viewing angle at which gray-scale inversion will not occur from about 25 degrees to about 40 degrees.

In FIG. 7, applied voltages giving the maximums of transmittance are nearly equal to one another at every viewing angle (about 2 volts in the example), but to be precise, as viewing angle increases, the peak of transmittance has a tendency to shift right. Thus, to prevent gray scale from being inverted at a viewing angle of 50 degrees, the lowest applied voltage V0 must be set to an applied voltage giving the maximum of transmittance in the V-T curve at a viewing angle of 50 degrees. Therefore, in this case, the lowest applied voltage V0 is set to be a small amount higher than 2 volts. Instead, V-T curves are integrated from a viewing angle of 0 degrees to a predetermined viewing angle (for example, a viewing angle of 50 degrees); that is, all sums of V-T curves are obtained with respect to a viewing angle of 0 degrees to the predetermined viewing angle. In a V-T curve thus obtained, as a result of integration with respect to the viewing angles, the lowest applied voltage may be set to an applied voltage giving the maximum of transmittance. Also in this case, the lowest applied voltage is set to a voltage a small amount higher than 2 volt.

As may be observed from FIG. 7, in the curve for a viewing angle of 0 degrees, transmittance (that is, brightness) starts to decrease at an applied voltage of approximately 1.8 volts. Therefore, if the lowest applied voltage V0 is set to too large a value, the maximum brightness at a viewing angle of 0 degrees decreases and an undesirable result is obtained. In accordance with the invention, to avoid the excessive decrease of the maximum brightness at a viewing angle of 0 degrees, the lowest applied voltage V0 is set to a voltage a little less than the voltage giving the maximum in the V-T curve. In the example, the lowest applied voltage V0 is set, for example, to about 1.8 volts. In FIG. 8(*b*), a curve indicated by a solid line 4 shows transmittance corresponding to the lowest applied voltage V0 for the case where it is set to 1.8 volts. As is apparent from curve 4, gray-scale inversion does not occur until the viewing angle reaches approximately 30 degrees. As described about, if the decrease of the maximum brightness at a viewing angle of 0 degrees is suppressed, a range of viewing angles within which gray-scale inversion does not occur will become narrow, accordingly. Nevertheless, curve 4 is superior to curve 6 (in which the present invention is not used) in terms of an improvement of gradation in curve 6. To widen the range of viewing angles within which gray-scale inversion does not occur without sacrificing the maximum brightness at an angle of 0 degrees, the lowest applied voltage V0 must be set, as described above, to a voltage which provides the maximum of transmittance in a V-T curve at the predetermined viewing angle to which the view is to be widened. If the lowest applied voltage V0 is set in this manner, the maximum brightness at a viewing angle of 0 degrees will decrease somewhat. Therefore, applied voltages V1 to V7 (voltages other than the lowest applied voltage V0) are reset in consideration of brightness and predetermined gamma correction for the lowest applied voltage V0.

Figure 9:
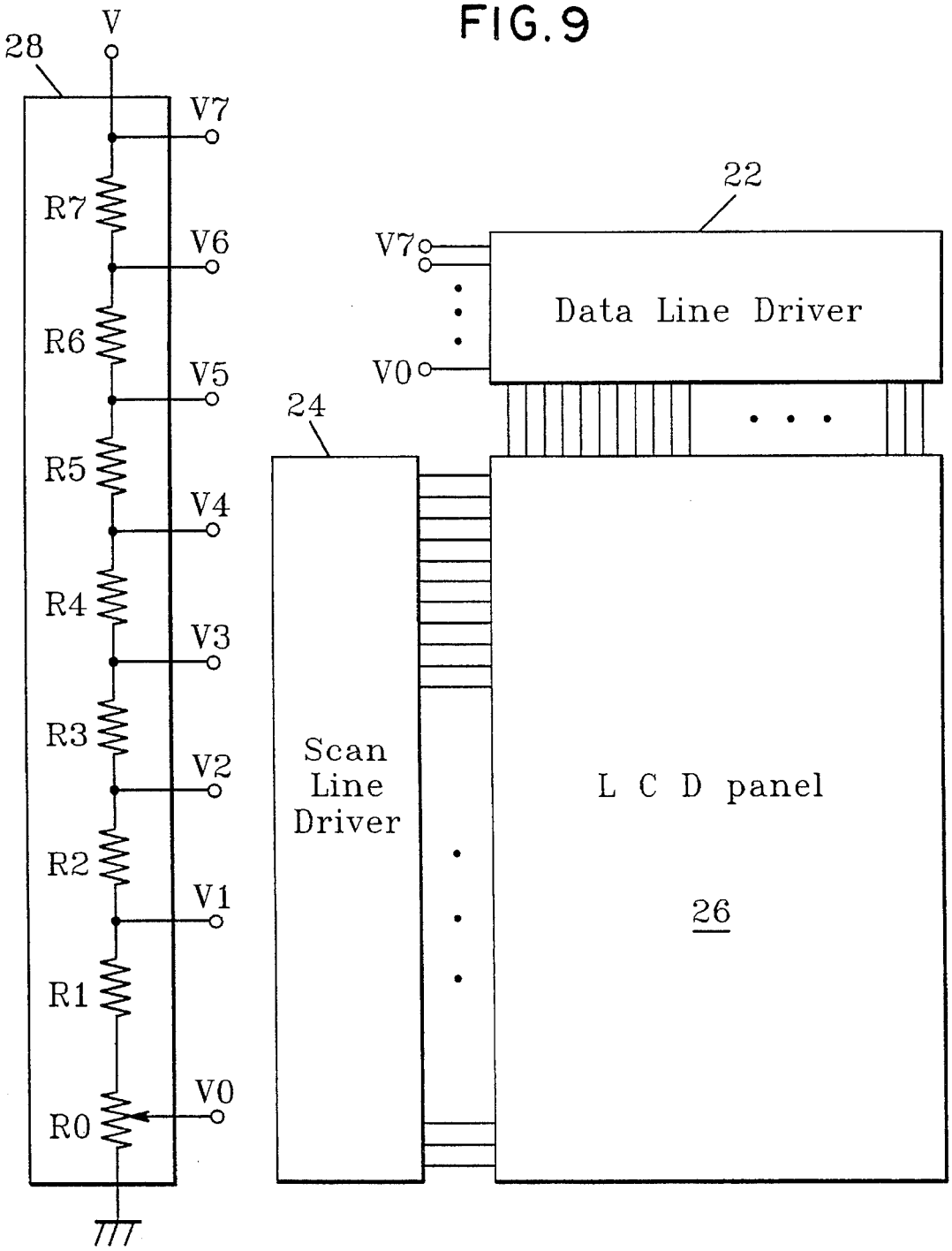
FIG. 9 is a diagram showing a liquid crystal display apparatus constructed in accordance with the present invention.

FIG. 9 illustrates the construction of a liquid crystal display apparatus according to the present invention wherein drivers are provided for supplying the voltages described above. The liquid crystal display apparatus comprises a LCD panel 26 in which a plurality of pixels are arranged in a matrix at the intersections of a plurality of data lines and a plurality of scan lines, a data line driver 22 for driving the data lines, a scan line driver 24 for driving the scan lines, and a reference voltage circuit 28 for supplying reference voltages to the data line driver 22. The reference voltages correspond to V0 to V7 described above. The reference voltage circuit 28 is comprised of a voltage source V, and resistors R0 to R7 corresponding to the reference voltages V0 to V7, respectively. The resistor R0 is variable and a value of the lowest applied voltage V0 is set, based on the variation of the resistor R0, to a desired value. If the lowest applied voltage V0 is set to about 1.8 volts in accordance with the above example, in the manner described above, the maximum brightness at a viewing angle of 0 degrees will decrease. Therefore, the applied voltages V1 to V7 (the voltages other than the lowest applied voltage V0) are reset in accordance with brightness and predetermined gamma correction for the lowest applied voltage V0. In this case, it is necessary to make the resistors R1 to R7 variable. However, it will be understood that, in any case, resistors R0 to R7 each may be designed to introduced a fixed amount of resistance. It will also be understood that a temperature compensating circuit may be built into the reference voltage circuit 28 to correct for the thermal variation characteristics of the threshold voltage in the liquid crystal material.

The product $\Delta nd$ may be optimized. $\Delta n$ is a measure of anisotropy in refractive index (the difference between refractive index for an ordinary ray and refractive index for an extraordinary ray) and d is the thickness of the liquid crystal layer. $\Delta nd$ is a parameter which determines the important characteristics of the liquid crystal such as contrast, viewing-angle dependence, etc. According to an experiment, it is clear that as Δnd increases (for example, Δnd=0.48 μm), the dependence on viewing angle of gray level G0 decreases or the amount of shift of color tone in the right- and the left-viewing zones and the up- and down-viewing zones decreases at a viewing angle of 0 degrees. It is also clear that as Δnd decreases (for example, Δnd=0.415 μm), gray-scale level G7 dependence on viewing angles decreases. Δnd can be selected according to whether a particular characteristic is regarded as being important.

Thus, the present invention, as described above, has an advantage in that both good contrast ratios and good gradation can be obtained at large viewing angles. The invention may be applied to both monochrome displays and color displays.

While the invention has been described in connection with specific embodiments, it will be understood that those with skill in the art may be able to develop variations of the disclosed embodiments without departing from the spirit of the invention or the scope of the following claims.

What is claimed is:

1. In a liquid crystal display apparatus operating in normally white mode, a method for driving the liquid crystal display apparatus wherein a gray scale display is obtained by providing different applied voltages corresponding to different gray scale levels, respectively, said gray scale display having a transmittance characteristic as a function of applied voltage which monotonically decreases over a range of applied voltage, the improvement comprising: setting a lowest applied voltage at a value within said range, whereby gray scale inversion is avoided over a wider range of viewing angles than when said lowest applied voltage is set lower than within said range without use of a viewing angle sensor.

2. The method for driving a liquid crystal display apparatus according to claim 1, wherein said transmittance characteristic is for a predetermined viewing angle with respect to a line normal to the display surface of said liquid crystal display apparatus.

3. The method for driving a liquid crystal display apparatus according to claim 1, wherein said lowest applied voltage is set to a voltage at least as great as a voltage which provides a maximum value of transmittance.

4. The method for driving a liquid crystal display apparatus according to claim 1, wherein said lowest applied voltage is set to a voltage which provides a maximum value of transmittance.

5. The method for driving a liquid crystal display apparatus according to claim 1, wherein applied voltages other than the lowest applied voltage of different applied voltages corresponding to different gray scale levels, respectively, are set based on said lowest applied voltage, t said monotonically decreasing region of said curve.

6. The method for driving a liquid crystal display apparatus according to claim 1, wherein said transmittance characteristic is an average transmittance characteristic between a viewing angle of 0 degrees and a predetermined viewing angle with respect to a line normal to the display surface of said liquid crystal display apparatus.

7. The method for driving a liquid crystal display apparatus according to claim 1 wherein, said liquid crystal display apparatus operates in extraordinary-ray dominant mode comprising the step of: setting a transmission axis of a polarizer on the incidence side of aid display apparatus in parallel with a rubbing direction on the incidence side so that an extraordinary ray can be transmitted.

8. A normally-white mode liquid crystal display apparatus, wherein gray scale display is obtained by providing different applied voltages corresponding to different respective gray scale levels, said gray scale display having a transmittance characteristic as a function of applied voltage which monotonically decreases over a range of applied voltage, wherein the improvement comprises: means for setting a lowest applied voltage at a value within said range, whereby gray scale inversion is avoided over a wider range of viewing angles than when said lowest applied voltage is set lower than within said range without use of a viewing angle sensor.

9. The liquid crystal display apparatus according to claim 8, which operates in an extraordinary-ray dominant mode, further comprising: a polarizer on the incidence side of said display apparatus having a transmission axis parallel to a rubbing direction on the incidence side so that an extraordinary ray can be transmitted.

10. In a normally-white mode liquid crystal display apparatus, including means for driving the liquid crystal display apparatus so that gray scale display is obtained by providing different applied voltages corresponding to different gray scale levels, respectively, said gray scale display having a transmittance characteristic as a function of applied voltage which monotonically decreases over a range of applied voltage, said apparatus comprising: an applied voltage setting means for setting a lowest applied voltage at a value within said range, whereby gray scale inversion is avoided over a wider range of viewing angles than when said lowest applied voltage is set lower than within said range without use of a viewing angle sensor.

11. The apparatus according to claim 10, which operates in an extraordinary-ray dominant mode further comprising: a polarizer on the incidence side of said display apparatus, the polarizer having a transmission axis set in parallel to a rubbing direction on the incidence side so that an extraordinary ray can be transmitted.

* * * * *